US006577743B2

(12) United States Patent
Masuda et al.

(10) Patent No.: US 6,577,743 B2
(45) Date of Patent: Jun. 10, 2003

(54) ELECTROACOUSTIC TRANSDUCER AND STRUCTURE FOR MOUNTING AN ELECTROACOUSTIC TRANSDUCER

(75) Inventors: Mitsuhiro Masuda, Shizuoka (JP); Yasunori Tsukuda, Shizuoka (JP); Yoshio Imahori, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 0 days.

(21) Appl. No.: 09/828,871

(22) Filed: Apr. 10, 2001

(65) Prior Publication Data

US 2001/0031056 A1 Oct. 18, 2001

(30) Foreign Application Priority Data

Apr. 13, 2000 (JP) ..... 2000-111492

(51) Int. Cl.[7] ..... H04R 25/00

(52) U.S. Cl. ..... 381/409; 381/410; 381/417; 439/65

(58) Field of Search ..... 381/396, 409, 381/410, 417, 386, 394, FOR 152, FOR 160; 439/65, 66, 74; 361/704

(56) References Cited

U.S. PATENT DOCUMENTS

| | | | | | |
|---|---|---|---|---|---|
| 4,029,375 | A | * | 6/1977 | Gabrielian | 439/66 |
| 5,790,377 | A | * | 8/1998 | Schreiber et al. | 361/704 |
| 6,072,886 | A | * | 6/2000 | Frasl et al. | 381/409 |
| 6,222,305 | B1 | * | 4/2001 | Beck et al. | 310/334 |
| 6,402,526 | B1 | * | 6/2002 | Schreiber et al. | 439/66 |

FOREIGN PATENT DOCUMENTS

| | | |
|---|---|---|
| EP | 385-888 A | 9/1990 |
| WO | WO 95-23434 A | 8/1995 |
| WO | WO 98-38832 A | 9/1998 |

* cited by examiner

*Primary Examiner*—Huyen Le
(74) *Attorney, Agent, or Firm*—Sughrue Mion, PLLC

(57) ABSTRACT

An electroacoustic transducer to be mounted on a board of a device, includes an anode conductive part which is in press contact with the board of the device, and a cathode conductive part which is in press contact with the board of the device, wherein the anode conductive part and the cathode conductive part are respectively placed at an axial center position or at predetermined positions in a radial direction to eliminate directionality in a circumferential direction.

7 Claims, 23 Drawing Sheets

ELECTROACOUSTIC TRANSDUCER AND STRUCTURE FOR MOUNTING AN ELECTROACOUSTIC TRANSDUCER

BACKGROUND OF THE INVENTION

1. Field of the Invention

The present invention relates to an electroacoustic transducer such as a sounder (buzzer), a microphone, or a loudspeaker, and more particularly to an improvement in which, in the case where an electroacoustic transducer is to be mounted on a board of one of various devices including a portable telephone, directionality in a circumferential direction (rotation direction) can be eliminated without using a sheet or a connector that may be separately prepared, thereby facilitating the mounting work.

2. Description of the Related Art

A sounder which is an electroacoustic transducer has a configuration such as shown in FIG. 21. The sounder has a case 301 which is configured by a top plate 303 and a cylindrical portion 305. Alternatively, the case 301 of the sounder may have a rectangular shape as shown in FIG. 23. A sound release hole 307 is formed in the center position of the top plate 303. A base 309 is placed in a lower portion of the inner space of the case 301, and a board 311 is placed on the side of the lower face of the base 309. A core 313 is attached to the center positions of the base 309 and the board 311. The base 309 and the core 313 constitute so-called "pole piece".

A coil 315 is placed on the base 309 and wound around the outer periphery of the core 313. A magnet 317 is interposed between the outer periphery of the coil 315 and the cylindrical portion 305 of the case 301, with forming a gap between the magnet and the coil 315.

A stepped portion 319 is formed in an inner peripheral side of an upper end portion of the cylindrical portion 305 of the case 301. A diaphragm 321 is placed on the stepped portion 319. The diaphragm 321 is configured by an elastic plate 323, and a magnetic piece 325 which serves as an additional mass fixed to the center position of the elastic plate 323.

The ends of the coil 315 are passed through the base 309 and the board 311, and then connected to a pair of lead terminals (not shown) which are disposed on the lower face of the board 311.

The thus configured sounder operates in the following manner. The diaphragm 321 is ordinarily attracted to the magnet 317 to have a certain polarity. When a current is supplied to the coil 315 via the pair of lead terminals under this state, the core 313 is electromagnetized. As a result, a magnetic field is generated at the forward end of the core. At this time, in the case where the magnetic pole which is generated at the core 313 is different in polarity from that of the diaphragm 321, the diaphragm 321 is attracted to the core 313.

By contrast, when the magnetic pole of the core 313 is identical in polarity with that of the diaphragm 321, the diaphragm 321 is repelled from the core 313. When a current is intermittently supplied in a certain direction, therefore, the diaphragm 321 repeatedly conducts the above-mentioned operations, with the result that the diaphragm 321 is oscillated at a predetermined frequency to generate a sound.

The sounder configured as described above is mounted on a board 327 in a housing of, for example, a portable telephone. In the mounting of the sounder to the board 327, a sheet 329 is attached to the sounder to eliminate directionality in a circumferential direction. Specifically, as shown in FIG. 22, an anode conductive part 329*a* and a cathode conductive part 329*b* are disposed on the lower face of the sheet 329 in ring-like shapes which are concentric with each other.

A large number of conductive pins are formed on the sheet 329. The anode conductive part 329*a* and the cathode conductive part 329*b* are made conductive with the board 311 through the conductive pins.

When the sheet 329 is attached to the sounder, the sounder has no directionality in a circumferential direction with respect to an anode conductive part and a cathode conductive part of the board 327 of the portable telephone. Even when the sounder is mounted on the board 327 with being rotated or positioned at any degree in a circumferential direction, therefore, conduction between the sounder and the board 327 can be surely attained.

The anode conductive part and the cathode conductive part of the board 327 are placed in given radial positions corresponding to the anode conductive part 329*a* and the cathode conductive part 329*b* of the sheet 329.

In FIG. 21, the reference numeral 331 denotes a gasket serving as a cushion member. In the mounting of the sounder to the board 327 in the housing of the portable telephone, various electronic components including the sounder are clamped by the board 327 and the housing. Therefore, the gasket 331 is placed.

As a measure for eliminating directionality in mounting in a circumferential direction, it may be contemplated to dispose a predetermined connector on the board 327 of the portable telephone in place of attachment of the sheet 329 to the sounder.

The above-described configuration of the conventional art has the following problems.

A sounder of the conventional art is not configured so that directionality in mounting in a circumferential direction can be eliminated on the side of the sounder. Therefore, a measure such as that the sheet 329 which is separately prepared is attached, or that a connector is attached to the board 327 is required. This produces problems that extra components are necessary, and that a cumbersome work must be compulsively conducted.

Another problem is caused by the use of the sheet or the connector. A sounder is shipped with the acoustic performance previously adjusted. The acoustic performance may be changed by the sheet 329 or the connector which is thereafter attached to the sounder, thereby producing a problem that a sounder cannot provide desired acoustic performance.

Specifically, when the sheet 329 or the connector is disposed on the back face of the sounder, it is expected that the resonance space on the rear side of the diaphragm is closed or narrowed, whereby acoustic performance is changed. As a countermeasure against this, it may be contemplated that acoustic performance is adjusted and set previously in consideration of the sheet 329 or the connector. However, the sheet 329 or the connector is configured in various manners in accordance with requirements of the user. Therefore, it is practically impossible to previously specify the kind of the sheet 329 or the connector.

Such a problem is commonly applicable not only to a sounder but also to various kinds of electroacoustic transducers such as a microphone or a loudspeaker.

SUMMARY OF THE INVENTION

The invention has been conducted in view of these problems, and therefore an object of the invention is to provide an electroacoustic transducer and a structure for mounting an electroacoustic transducer on a board of an external device in which directionality in a circumferential direction in mounting can be eliminated without changing the acoustic performance.

To achieve the above object, according to a first aspect of the invention, there is provided an electroacoustic transducer to be mounted on a board of a device, comprising:

an anode conductive part which is in press contact with the board of the device; and a cathode conductive part which is in press contact with the board of the device;

wherein said anode conductive part and said cathode conductive part are respectively placed at an axial center position or at predetermined positions in a radial direction to eliminate directionality in a circumferential direction.

According to a second aspect of the invention, in the electroacoustic transducer of the first aspect of the invention, said anode conductive part and said cathode conductive part are disposed in substantially ring-like shapes which are concentric with each other.

According to a third aspect of the invention, in the electroacoustic transducer of the first or second aspect of the invention, said anode conductive part and said cathode conductive part are projected toward said board, respectively.

According to a fourth aspect of the invention, in the electroacoustic transducer of the first or second aspect of the invention, at least one of said anode conductive part and said cathode conductive part is a coil spring or a plate spring.

According to a fifth aspect of the invention, in the electroacoustic transducer of the fourth aspect of the invention, said anode conductive part and said cathode conductive part are coil springs disposed concentrically, and a distance between the coil springs is larger toward a board of the device.

According to a sixth aspect of the invention, there is provided a structure for mounting an electroacoustic transducer on a device, comprising:

a pair of conductive parts of the electroacoustic transducer comprising an anode conductive part and a cathode conductive part;

a pair of conductive parts of the device comprising an anode conductive part and a cathode conductive part;

wherein at least one of the pairs of conductive parts is disposed in substantially ring-like shape with the anode conductive part is concentric with the cathode conductive part, thus eliminating directionality in a circumferential direction.

According to a seventh aspect of the invention, in the structure for mounting an electroacoustic transducer of the sixth aspect of the invention, one of the pairs is disposed in substantially ring-like shape and the other is disposed in predetermined positions in a radial direction corresponding to the position of said one of the pairs.

In the electroacoustic transducer of the first aspect of the invention, directionality in a circumferential direction is eliminated by respectively placing the anode conductive part and the cathode conductive part in predetermined positions including an axial center position in a radial direction. The electroacoustic transducer may be configured in various manners.

In the second aspect of the invention, for example, the directionality in a circumferential direction may be eliminated by disposing the anode conductive part and the cathode conductive part in substantially ring-like shapes which are concentric with each other. In this case, the anode conductive part and the cathode conductive part of a board of a device on which the electroacoustic transducer is to be mounted are not always required to be disposed in substantially ring-like shapes which are concentric with each other, and are requested only to be respectively disposed in predetermined positions in a radial direction.

In the third aspect of the invention, the electroacoustic transducer is configured so that, in the electroacoustic transducer of the first or second aspect of the invention, the anode conductive part and/or the cathode conductive part is configured by a coil spring or a plate spring. According to this configuration, a desired press contact force can be surely obtained, and a more sure contact state can be provided.

In the electroacoustic transducer of the fourth aspect of the invention, when both of the anode conductive part and the cathode conductive part are respectively shaped coil springs and disposed concentrically, the distance between the coil springs is larger toward the board of the device. According to this configuration, a contact between the anode conductive part and the cathode conductive part which may be caused by compression in mounting, and a short circuit caused by such a contact can be surely prevented from occurring.

In the structure for mounting an electroacoustic transducer of the fifth aspect of the invention, between an anode conductive part and a cathode conductive part of an electroacoustic transducer, and an anode conductive part and a cathode conductive part of one of various devices on which the electroacoustic transducer is to be mounted, the anode conductive part and the cathode conductive part, and/or the anode conductive part and the cathode conductive part are disposed in substantially ring-like shapes which are concentric with each other, thereby eliminating directionality in a circumferential direction. In this case, various combinations may be employed between the electroacoustic transducer and the board of the device.

In the sixth aspect of the invention, for example, a configuration may be employed in which one of a set of the anode conductive part and the cathode conductive part and a set of the board anode conductive part and the board cathode conductive part is disposed in substantially ring-like shapes which are concentric with each other, and another set is disposed in predetermined positions in a radial direction and corresponding to positions of the substantially ring-like shapes which are concentric with each other.

DETAILED DESCRIPTION OF THE PREFERRED EMBODIMENTS

Now, a description will be given in more detail of preferred embodiments of the invention with reference to the accompanying drawings.

Figure 1:
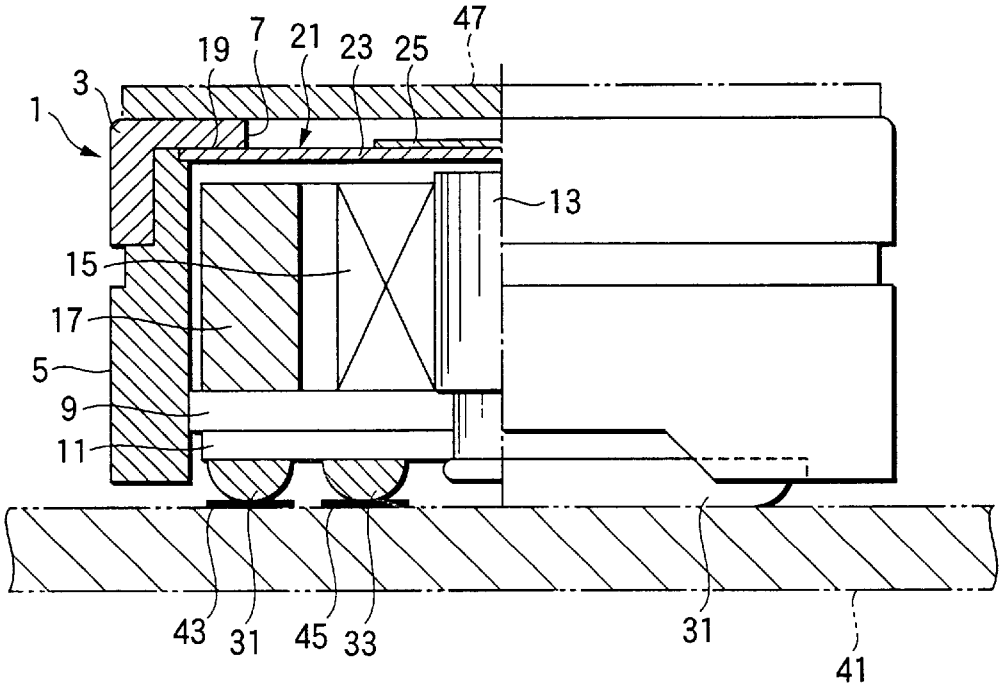
FIG. 1 is a half section view showing the configuration of a sounder serving as an electroacoustic transducer according to a first embodiment of the invention.

Hereinafter, a first embodiment of the invention will be described with reference to FIGS. 1 to 4. In the embodiment, the invention is applied to a sounder which is an electroacoustic transducer. The sounder is configured as shown in FIG. 1.

The sounder has a case 1 which is configured by a top plate 3 and a cylindrical portion 5. A sound release hole 7 is formed in the center position of the top plate 3. A base 9 is placed in a lower portion of the inner space of the case 1, and a board 11 is placed on the lower face of the base 9. A core 13 is attached to the center positions of the base 9 and the board 11. The base 9 and the core 13 constitute so-called "pole piece".

A coil 15 is placed on the base 9 and wound around the outer periphery of the core 13. A magnet 17 is interposed between the outer periphery of the coil 15 and the cylindrical portion 5 of the case 1, with forming a gap between the magnet and the coil 15.

A stepped portion 19 is formed in an inner peripheral side of an upper end portion of the cylindrical portion 5 of the case 1. A diaphragm 21 is placed on the stepped portion 19. The diaphragm 21 is configured by an elastic plate 23, and a magnetic piece 25 which serves as an additional mass fixed to the center position of the elastic plate 23.

Figure 2:
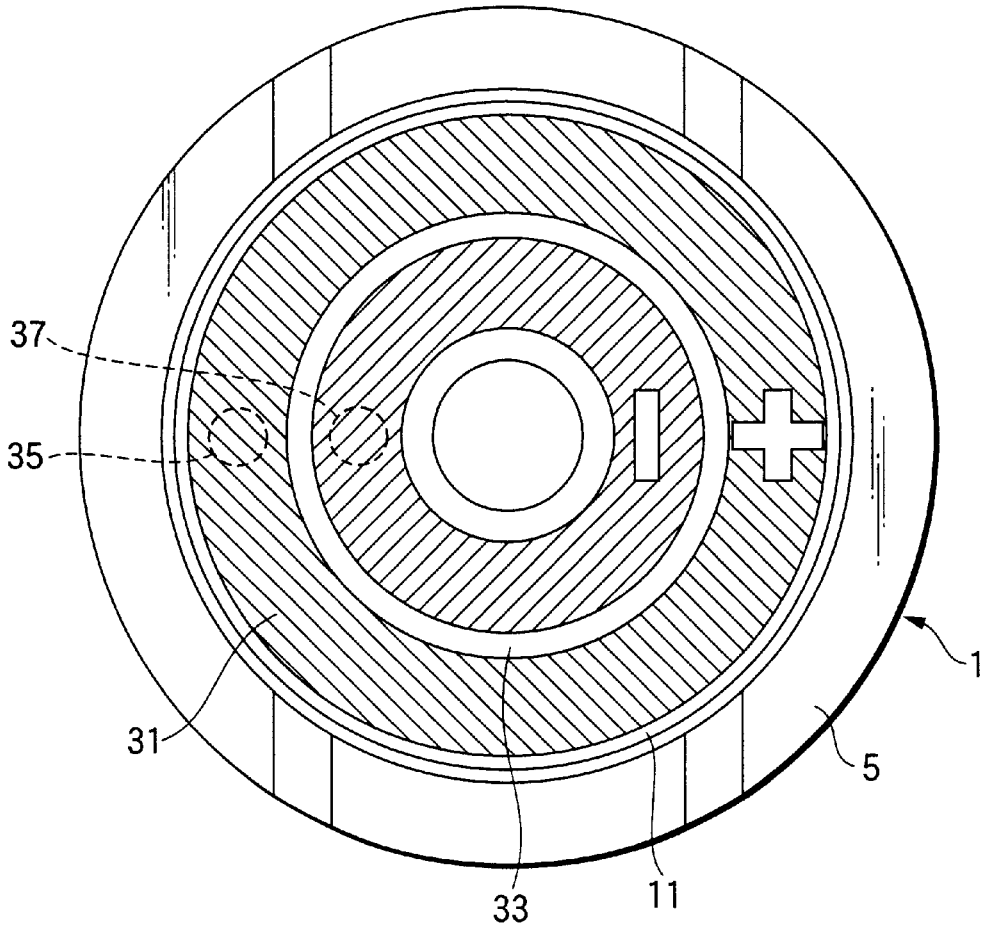
FIG. 2 is a bottom view showing a sounder serving as an electroacoustic transducer according to the first embodiment of the invention.

An anode conductive part 31 is disposed in a ring-like shape on the rear face of the board 11. The anode conductive part 31 has a substantially semicircular cross section shape. A forward end portion of the anode conductive part protrudes by a small distance from the lower end of the cylindrical portion 5 of the case 1. A cathode conductive part 33 is disposed inside the anode conductive part 31 in a ring-like shape which is concentric with the anode conductive part. The cathode conductive part 33 also has a substantially semicircular cross section shape. FIG. 2 shows a state of the anode conductive part 31 and the cathode conductive part 33 as seeing from the side of the lower face.

For example, the anode conductive part 31 and the cathode conductive part 33 are configured by depositing solder. Alternatively, these parts may be made of one of various conductive materials and then attached to the board.

As shown in FIG. 2, through holes 35 and 37 are disposed on the board 11 corresponding to the positions of the anode conductive part 31 and the cathode conductive part 33, respectively. The through holes 35 and 37 are formed so as to elongate from the upper face of the board 11 to the lower face to pass therethrough. The ends of the coil 15 which has been described above are connected to the upper face sides of the through holes 35 and 37, and the lower face sides of the through holes 35 and 37 are connected to the anode conductive part 31 and the cathode conductive part 33, respectively. Namely, the coil ends (not shown) of the coil 15 are connected to the anode conductive part 31 and the cathode conductive part 33 via the through holes 35 and 37, respectively.

The thus configured sounder operates in the following manner.

The diaphragm 21 is ordinarily attracted by the magnet 17, whereby the diaphragm is set to have a certain polarity. When a current is supplied to the coil 15 via a pair of lead terminals under this state, the core 13 is electromagnetized. As a result, a magnetic field is generated at the forward end of the core. At this time, in the case where the magnetic pole which is generated at the core 13 is different in polarity from that of the diaphragm 21, the diaphragm 21 is attracted to the core 13.

By contrast, when the magnetic pole of the core 13 is identical in polarity with that of the diaphragm 21, the diaphragm 21 is repelled from the core 13. When a current is intermittently supplied in a certain direction, therefore, the diaphragm 21 repeatedly conducts the above-mentioned operations, with the result that the diaphragm 21 is oscillated at a predetermined frequency to generate a sound.

Next, the case where the sounder is to be mounted on, for example, a board 41 of a portable telephone will be described. On the board 41, an anode conductive part 43 and a cathode conductive part 45 are previously disposed in predetermined positions. The anode conductive part 43 and the cathode conductive part 45 are placed in given radial positions which are separated from the center position of the mounting, respectively. The given radial positions means radial positions which correspond to the anode conductive part 31 and the cathode conductive part 33 of the sounder, respectively.

Then, the sounder is mounted on the board 41. As a result, the sounder is placed in a predetermined mounting position so as to be mounted in a state where the sounder is clampingly held by a housing (not shown) of the portable telephone and the board 41. A gasket 47 serving as a cushion member is interposed between the housing and the sounder.

The embodiment is configured so that, in the sounder, the anode conductive part 31 and the cathode conductive part 33 are disposed in ring-like shapes which are concentric with each other, and hence directionality in a circumferential direction is eliminated. Even when the sounder is mounted with being rotated in any angle in a circumferential direction, therefore, the anode conductive part 31 of the sounder is surely in contact with the anode conductive part 43 of the board 41, and the cathode conductive part 33 of the sounder is surely in contact with the cathode conductive part 45 of the board 41.

However, the axial center of the sounder must be made coincident with the center of the mounting area on the board 41. This can be realized by, for example, providing a position restricting portion projected from the board 41 or the housing.

The embodiment described above can attain the following effects.

In the sounder, the anode conductive part 31 and the cathode conductive part 33 are disposed in ring-like shapes which are concentric with each other, thereby eliminating directionality in a circumferential direction. When the sounder is to be mounted on, for example, the board 41 of a portable telephone, therefore, the mounting work can be easily performed. This is because, even when the sounder is mounted with being rotated in any angle in a circumferential direction, the anode conductive part 31 of the sounder can be surely in contact with the anode conductive part 43 of the board 41, and the cathode conductive part 33 of the sounder can be surely in contact with the cathode conductive part 45 of the board 41.

In this case, unlike the conventional art, it is not necessary to separately prepare a sheet or a connector. This is effective not only in reducing the number of parts and facilitating the mounting work, but also in preventing the acoustic performance of the sounder from being accidentally changed. At a shipment of a sounder, usually, the sounder is adjusted and set so as to have predetermined acoustic performance. When a sheet or a connector which is separately prepared is disposed on a sounder in mounting, the resonance space on the rear side of the diaphragm is closed or narrowed, thereby causing a problem that acoustic performance is changed. In the embodiment, such a problem does not occur, and the original acoustic performance can be maintained as it is.

Figure 3:
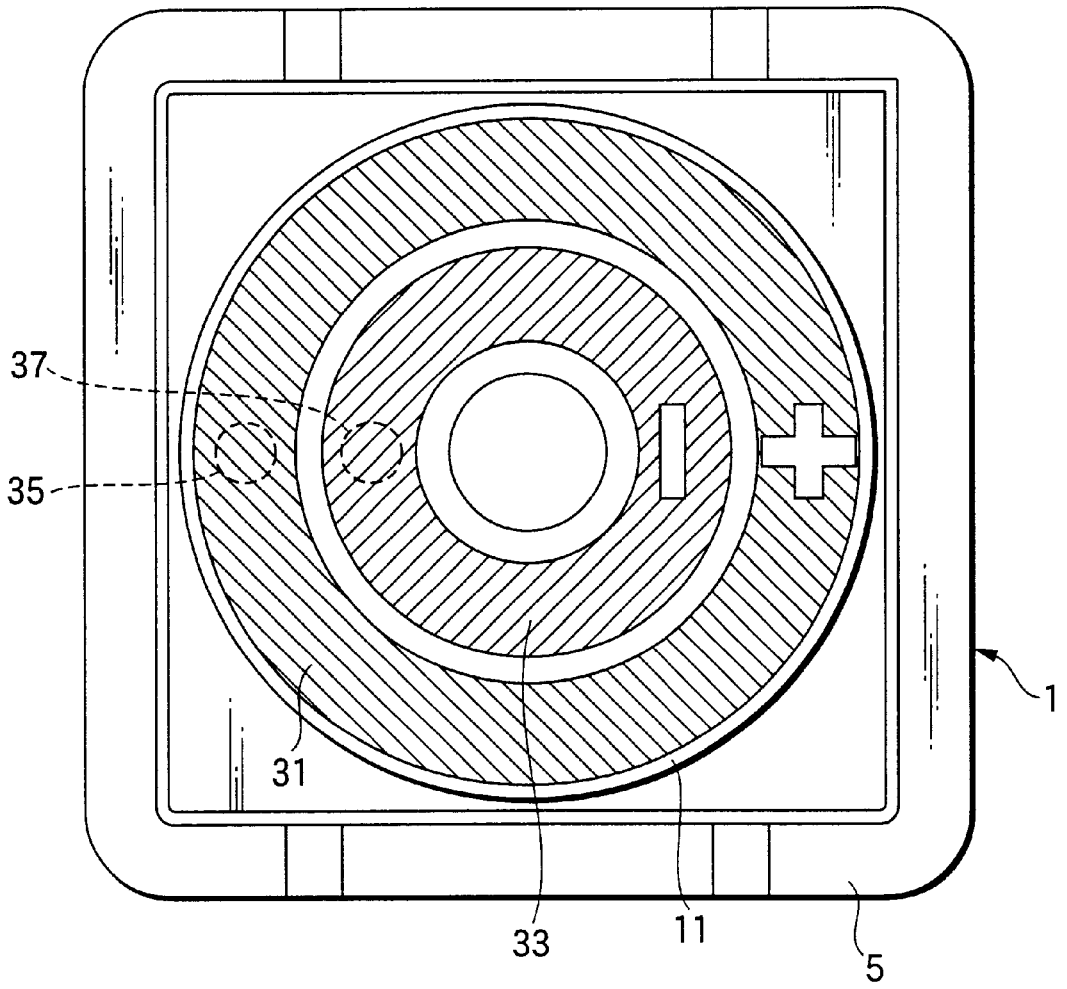
FIG. 3 is a bottom view showing a sounder serving as an electroacoustic transducer according to the first embodiment of the invention.
Figure 4:
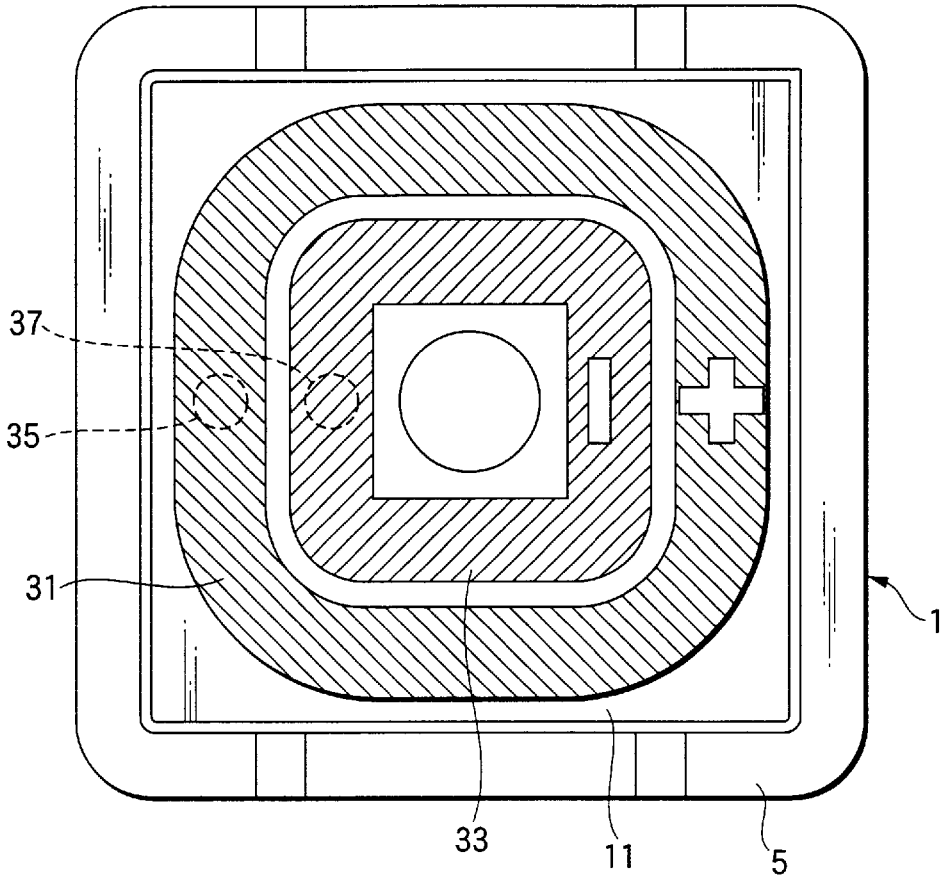
FIG. 4 is a bottom view showing a sounder serving as an electroacoustic transducer according to the first embodiment of the invention.

In FIGS. 1 and 2, the example is shown in which the case 1 of the sounder is cylindrical, and the anode conductive part 31 and the cathode conductive part 33 are disposed in ring-like shapes which are concentric with each other. Alternatively, as shown in FIG. 3, the case 1 may be configured to be rectangular, or, as shown in FIG. 4, not only the case 1 but also the anode conductive part 31 and the cathode conductive part 33 may be disposed in substantially ring-like shapes (in this case, rectangular shapes) which are concentric with each other.

Figure 5:
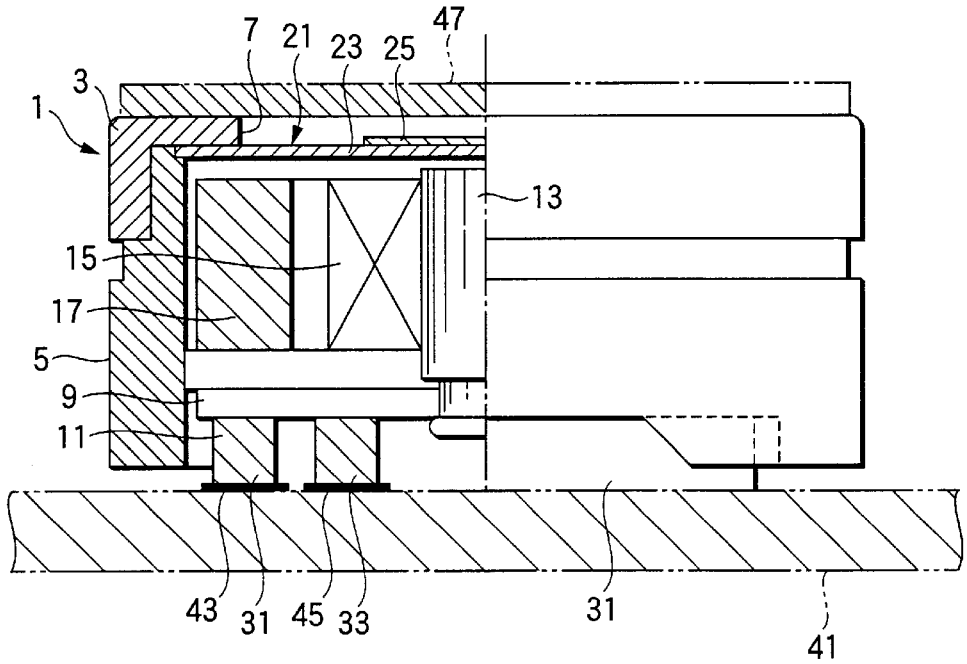
FIG. 5 is a half section view showing the configuration of a sounder serving as an electroacoustic transducer according to a second aspect of the invention.
Figure 6:
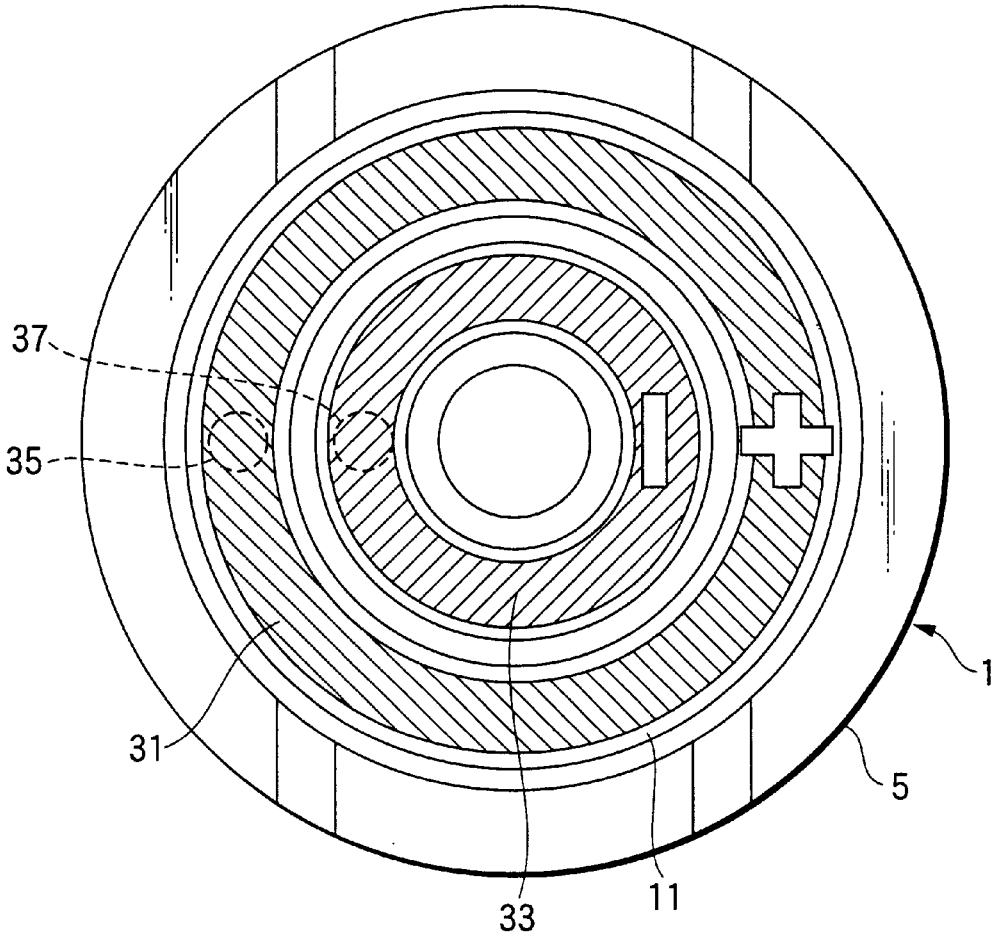
FIG. 6 is a bottom view showing a sounder serving as an electroacoustic transducer according to the second embodiment of the invention.

Next, a second embodiment of the invention will be described with reference to FIGS. 5 to 7. In the embodiment, the anode conductive part 31 and the cathode conductive part 33 of the sounder are different in shape from the first embodiment. Namely, the anode conductive part 31 and the cathode conductive part 33 have a rectangular cross section shape which vertically elongates, and protrude from the lower end of the cylindrical portion 5 of the case 1 by a larger distance.

The other components are configured in the same manner as those of the first embodiment. Identical components are denoted by the same reference numerals, and their description is omitted.

Therefore, the embodiment can attain the same effects as those of the first embodiment. Moreover, the different shape and the increased protruding amount of the anode conductive part 31 and the cathode conductive part 33 can further ensure the contacts with the anode conductive part 43 and the cathode conductive part 45 of the board 41.

Figure 7:
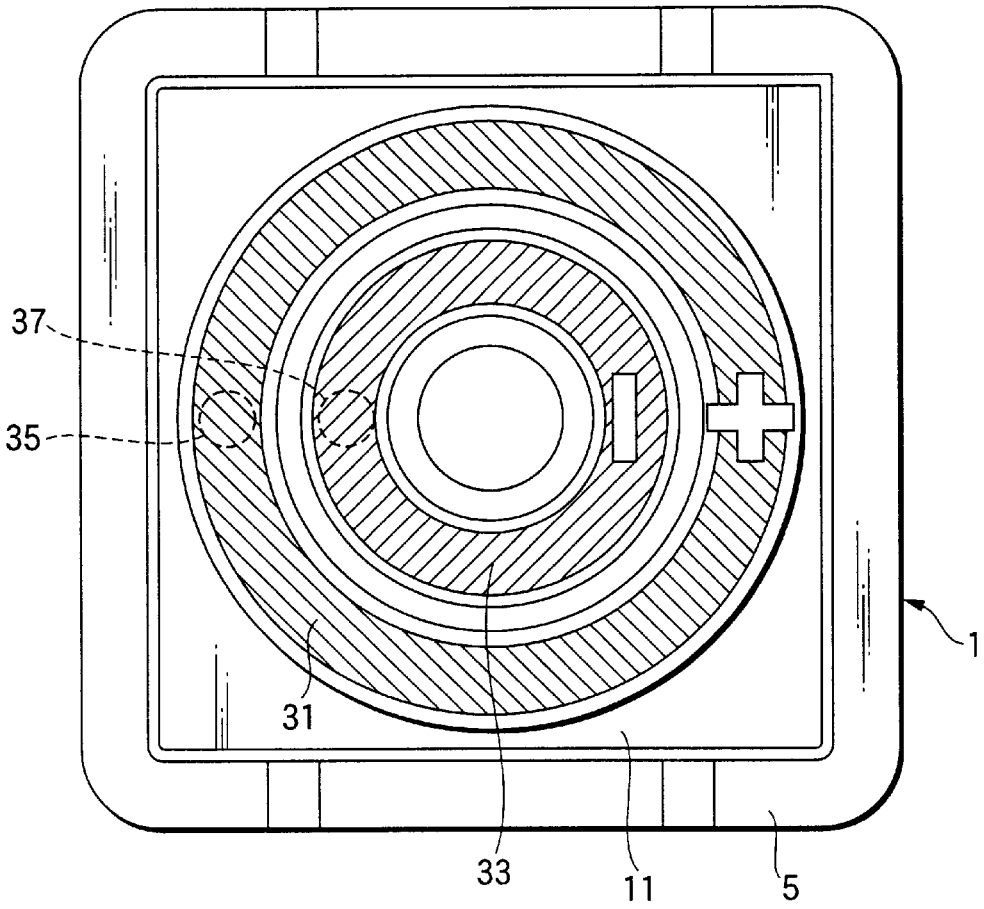
FIG. 7 is a bottom view showing a sounder serving as an electroacoustic transducer according to the second embodiment of the invention.

In the embodiment also, as shown in FIG. 7, the case 1 may be configured to be rectangular, or, although not shown, the anode conductive part 31 and the cathode conductive part 33 may be disposed in substantially ring-like shapes (for example, rectangular shapes) which are concentric with each other.

Figure 8:
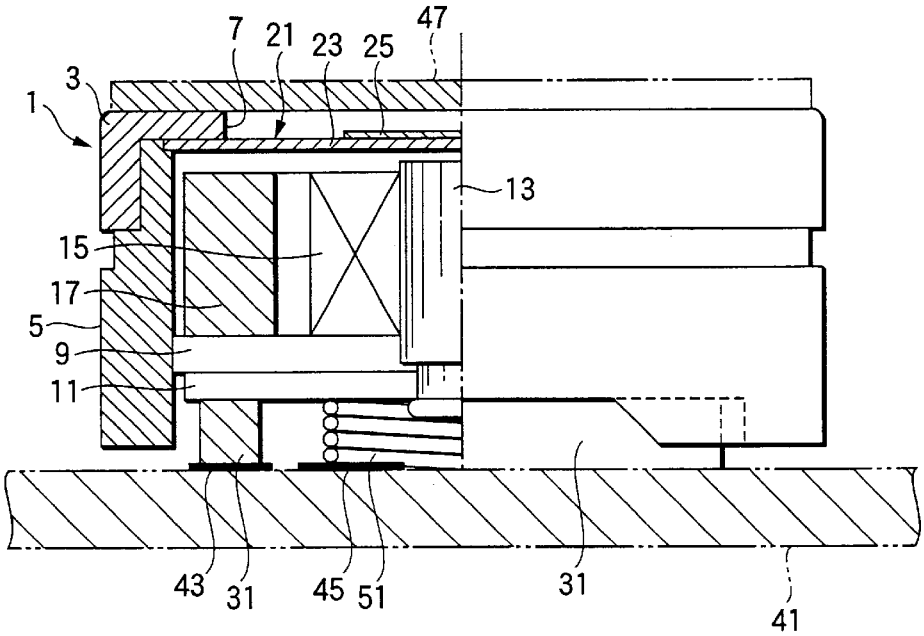
FIG. 8 is a half section view showing a sounder serving as an electroacoustic transducer according to a third embodiment of the invention.
Figure 9:
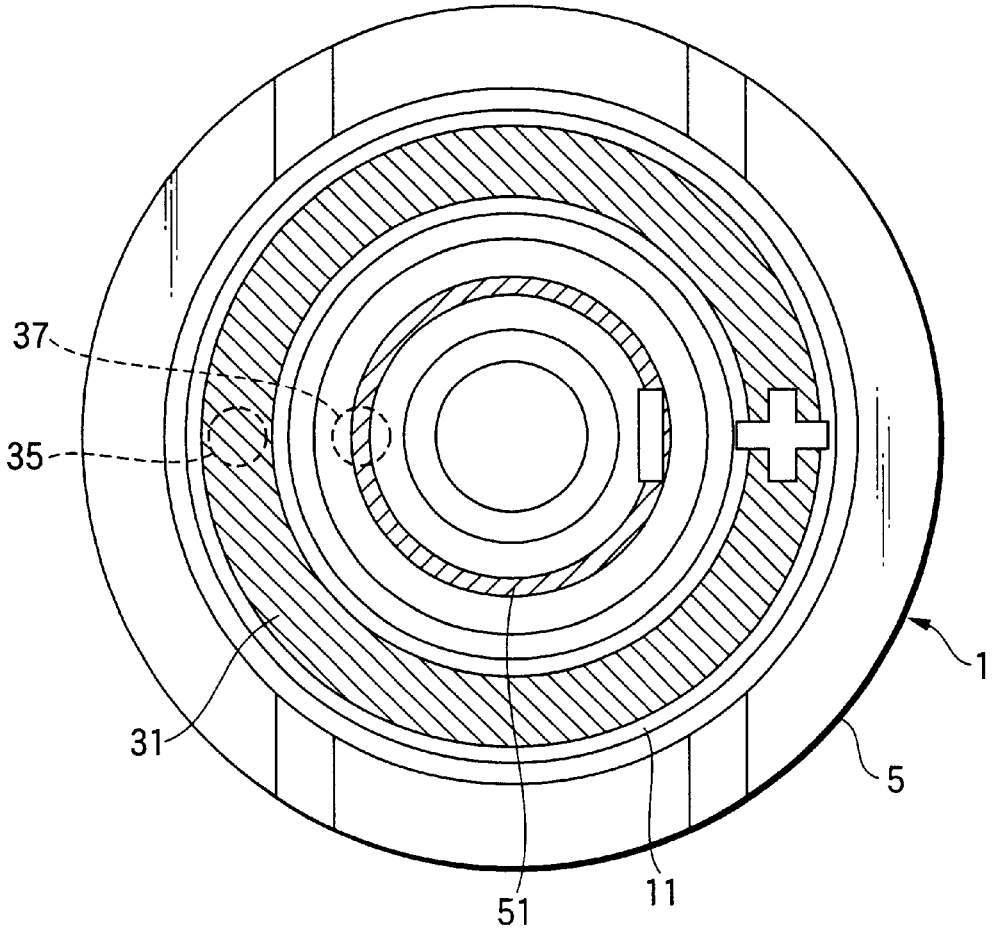
FIG. 9 is a bottom view showing a sounder serving as an electroacoustic transducer according to the third embodiment of the invention.

Next, a third embodiment of the invention will be described with reference to FIGS. 8 to 10. In the embodiment, the cathode conductive part 33 is configured as a coil spring 51.

The other components are configured in the same manner as those of the second embodiment. Identical components are denoted by the same reference numerals, and their description is omitted.

Therefore, the embodiment can attain the same effects as those of the second embodiment. Moreover, the employment of the coil spring 51 can further ensure the contact with the conductive part of the board 41.

Figure 10:
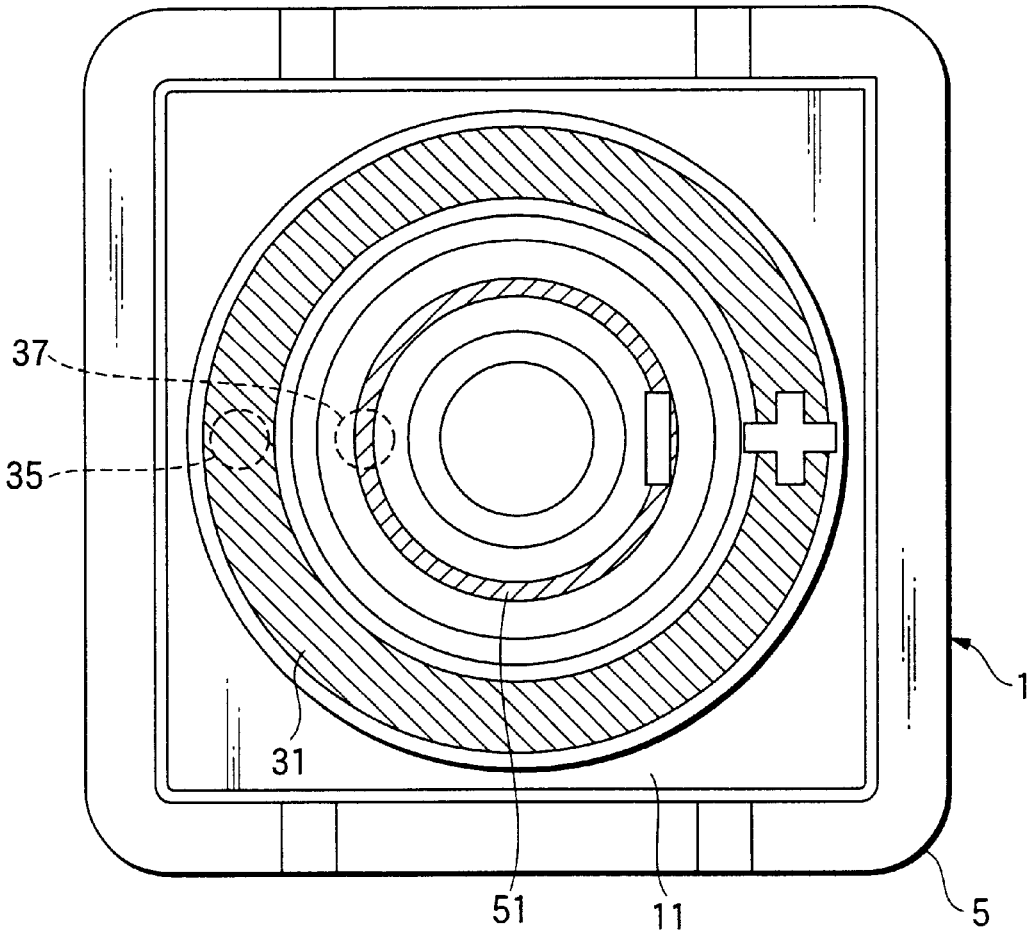
FIG. 10 is a bottom view showing a sounder serving as an electroacoustic transducer according to the third embodiment of the invention.

In the embodiment also, as shown in FIG. 10, the case 1 may be configured to be rectangular.

Figure 11:
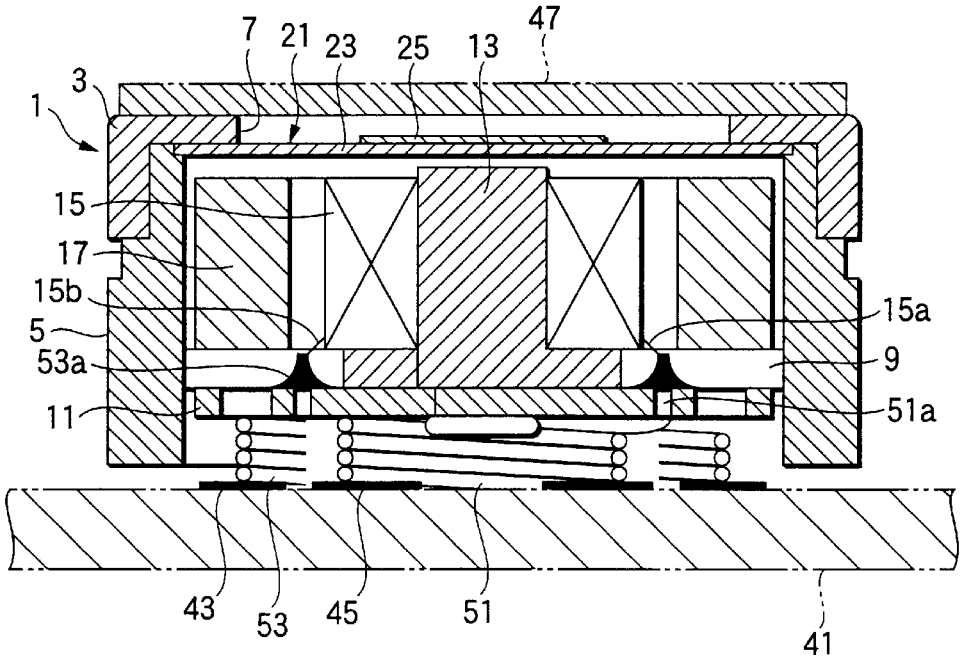
FIG. 11 is a half section view showing a sounder serving as an electroacoustic transducer according to a fourth embodiment of the invention.
Figure 12:
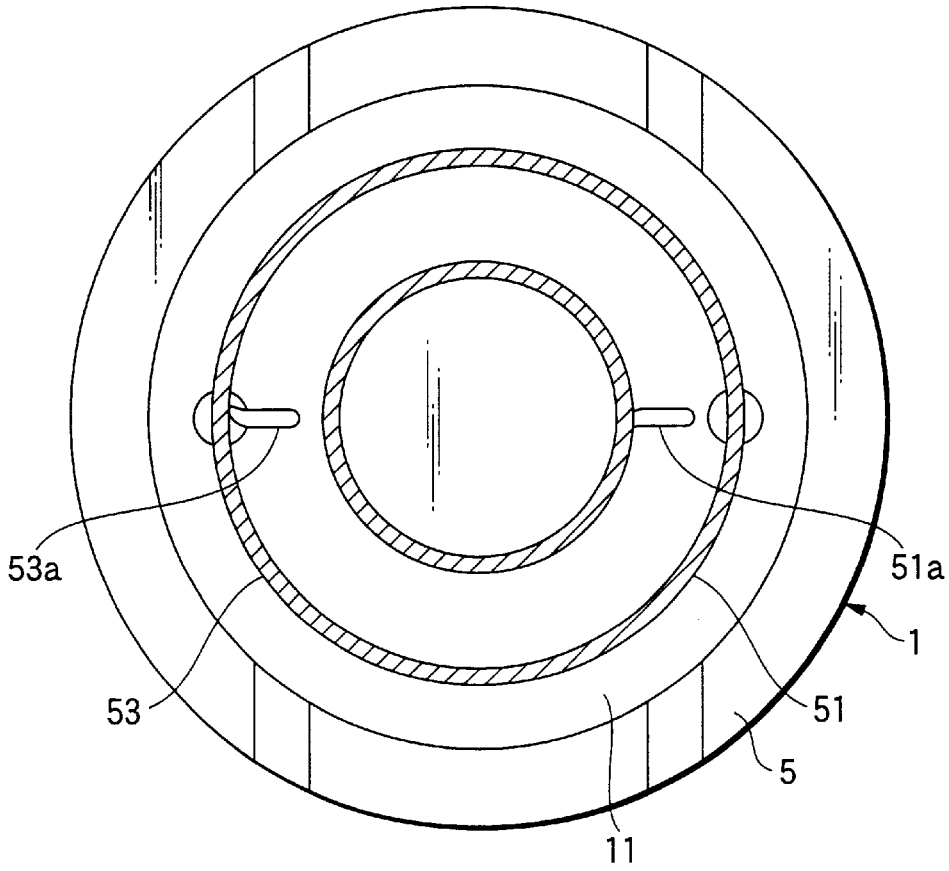
FIG. 12 is a bottom view showing a sounder serving as an electroacoustic transducer according to the fourth embodiment of the invention.

Next, a fourth embodiment of the invention will be described with reference to FIGS. 11 to 13. In the embodiment, the anode conductive part 31 is also configured as a coil spring 53. In the embodiment, moreover, the board 11 is configured as a so-called single-sided board. In the first to third embodiments described above, the board 11 is configured and used as so-called "two-sided board" with conductive through holes. By contrast, in the fourth embodiment, the board is configured as a single-sided board.

Specifically, an end portion 51*a* of the coil spring 51 is passed through the board 11 to be on the upper side, and then connected to a coil end 15*a* of the coil 15. Similarly, an end portion 53*b* of the coil spring 53 also is passed through the board 11 to be placed on the upper side, and then connected to a coil end 15*b* of the coil 15. According to this configuration, the board 11 can be configured as a single-sided board in which conductive through holes are not used.

The other components are configured in the same manner as those of the third embodiment. Identical components are denoted by the same reference numerals, and their description is omitted.

Therefore, the embodiment can attain the same effects as those of the third embodiment. Moreover, the employment of the coil springs can further ensure the contacts with the conductive parts of the board 41, and allows the board 11 to be configured as "single-sided board", so that the configuration of the board 11 can be simplified and the production cost of the board can be reduced.

Figure 13:
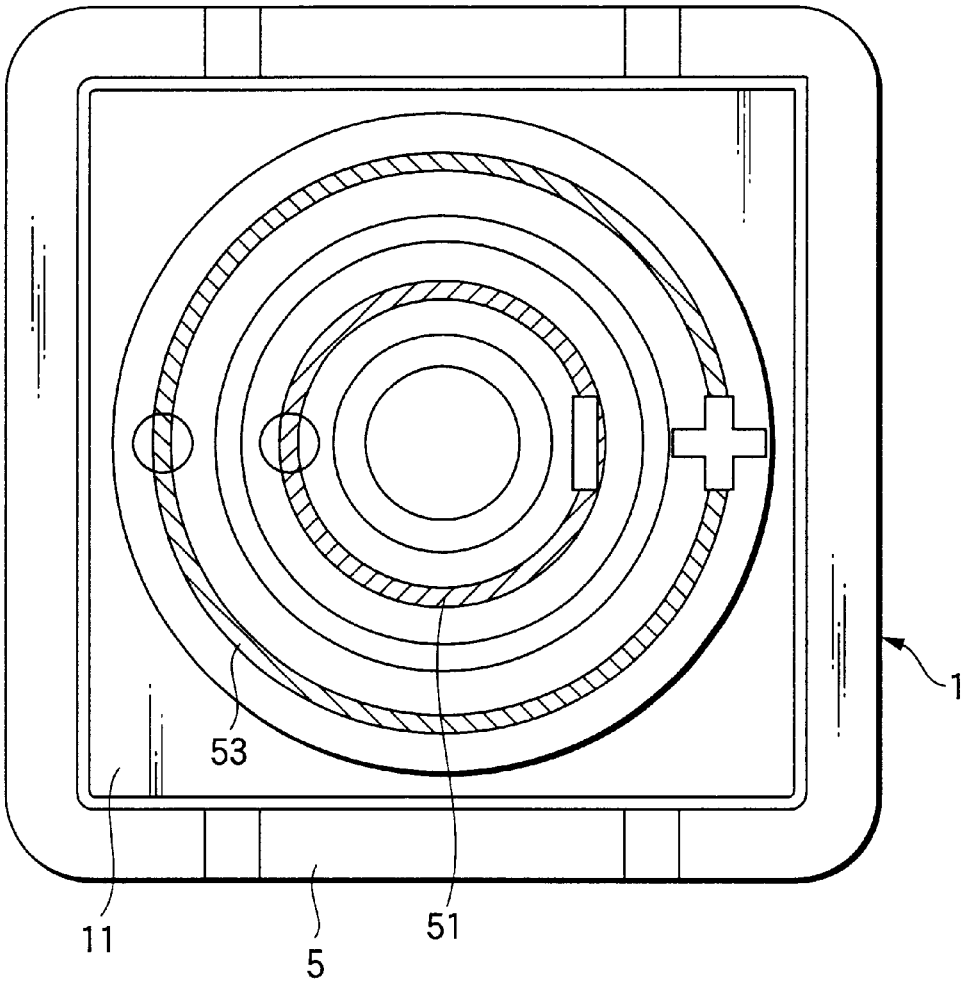
FIG. 13 is a bottom view showing a sounder serving as an electroacoustic transducer according to the fourth embodiment of the invention.

In the embodiment also, as shown in FIG. 13, the case 1 may be configured to be rectangular.

In the first, second, and third embodiments, the ends of the coil 15 may be drawn through the board to the lower face of the board 11 and then soldered to the conductive parts, whereby the board 11 can be configured as a single-sided board.

Figure 14:
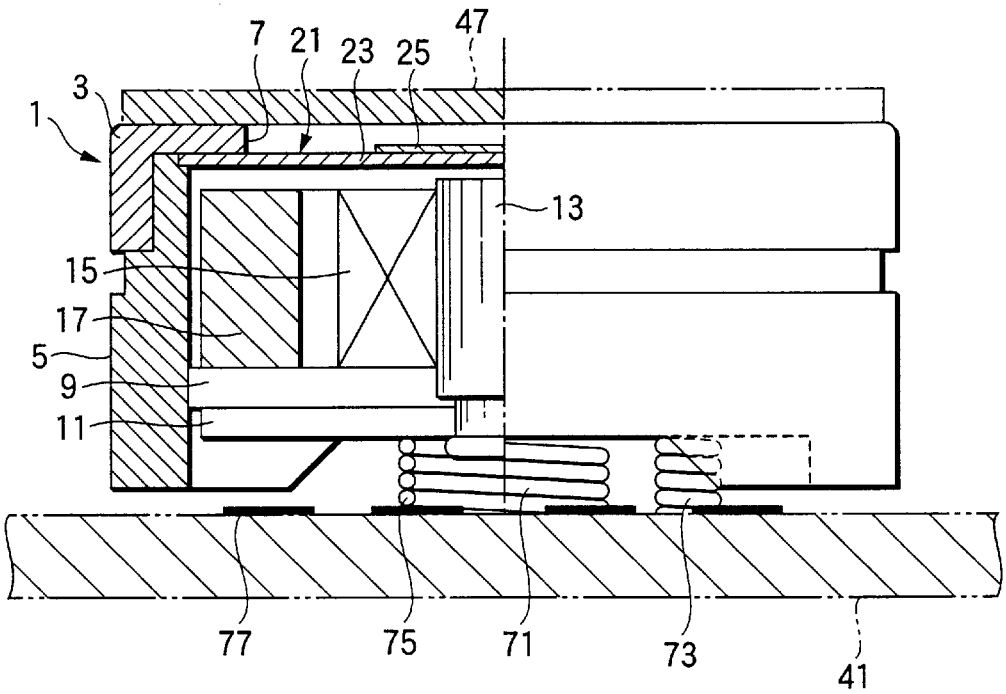
FIG. 14 is a half section view showing a sounder serving as an electroacoustic transducer according to a fifth embodiment of the invention.
Figure 15:
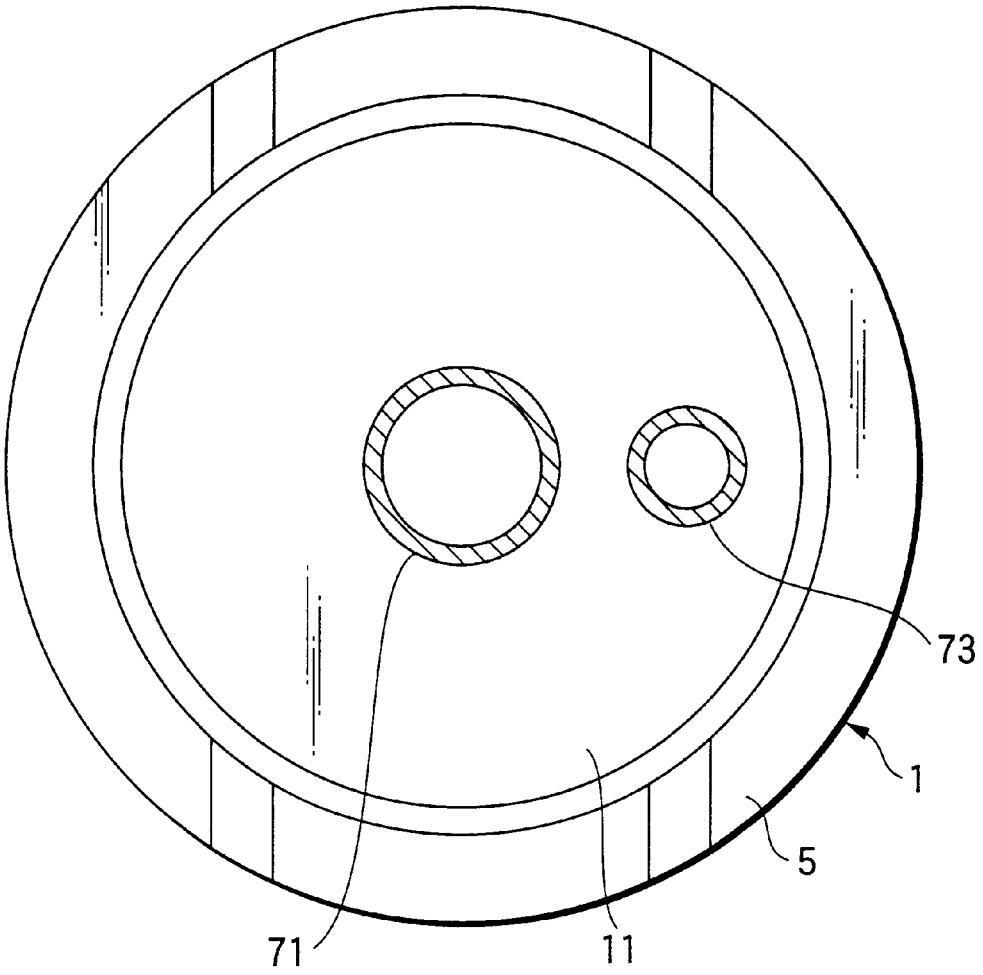
FIG. 15 is a bottom view showing a sounder serving as an electroacoustic transducer according to the fifth embodiment of the invention.

Next, a fifth embodiment of the invention will be described with reference to FIGS. 14 to 16. In the embodiment, in the sounder, a coil spring 71 serving as an anode conductive part is disposed in the center position, and a coil spring 73 serving as a cathode conductive part is placed in a position which is separated from the center by a predetermined radial distance.

Figure 16:
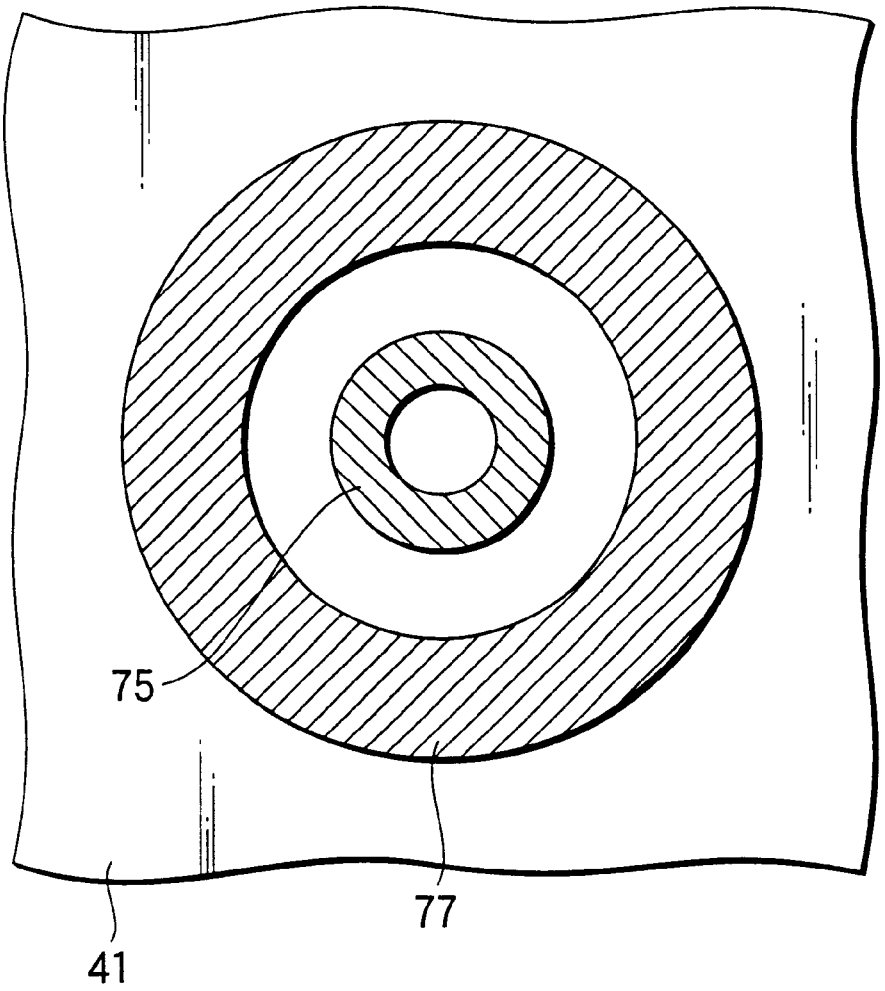
FIG. 16 is a partial plan view showing a board of a portable telephone according to the fifth embodiment of the invention.

On the other hand, as shown in FIG. 16, an anode conductive part 75 and a cathode conductive part 77 of the board 41 are disposed in ring-like shapes which are concentric with each other.

The other components are configured in the same manner as those of the embodiments described above. Identical components are denoted by the same reference numerals, and their description is omitted.

According to the embodiment, in the board 41 of the portable telephone, the anode conductive part 75 and the cathode conductive part 77 are disposed in ring-like shapes which are concentric with each other, thereby eliminating directionality in a circumferential direction. In the sounder, the coil spring 71 is placed in the center position so as to correspond to the anode conductive part 75 of the board 41 of the portable telephone, and the coil spring 73 serving as the cathode conductive part is placed in a position which is separated from the center by a predetermined distance, so as to correspond to the cathode conductive part 77.

In this configuration also, it is possible to attain the same effects, i.e., that directionality in a circumferential direction in mounting can be eliminated without separately using a sheet or a connector, and that the acoustic performance of the sounder can be prevented from being accidentally changed.

Figure 17:
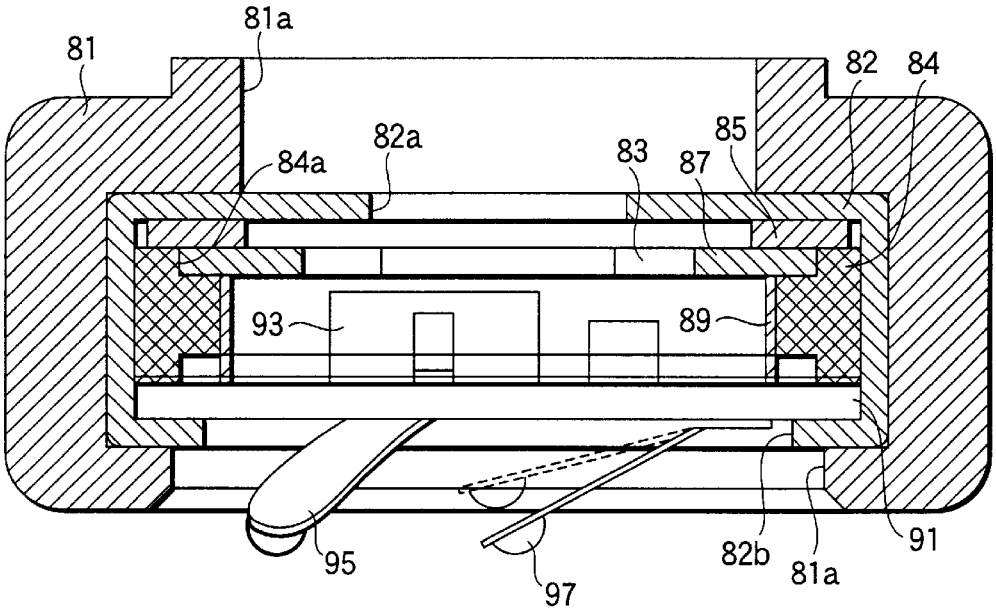
FIG. 17 is a section view showing a microphone serving as an electroacoustic transducer according to a sixth embodiment of the invention.
Figure 18:
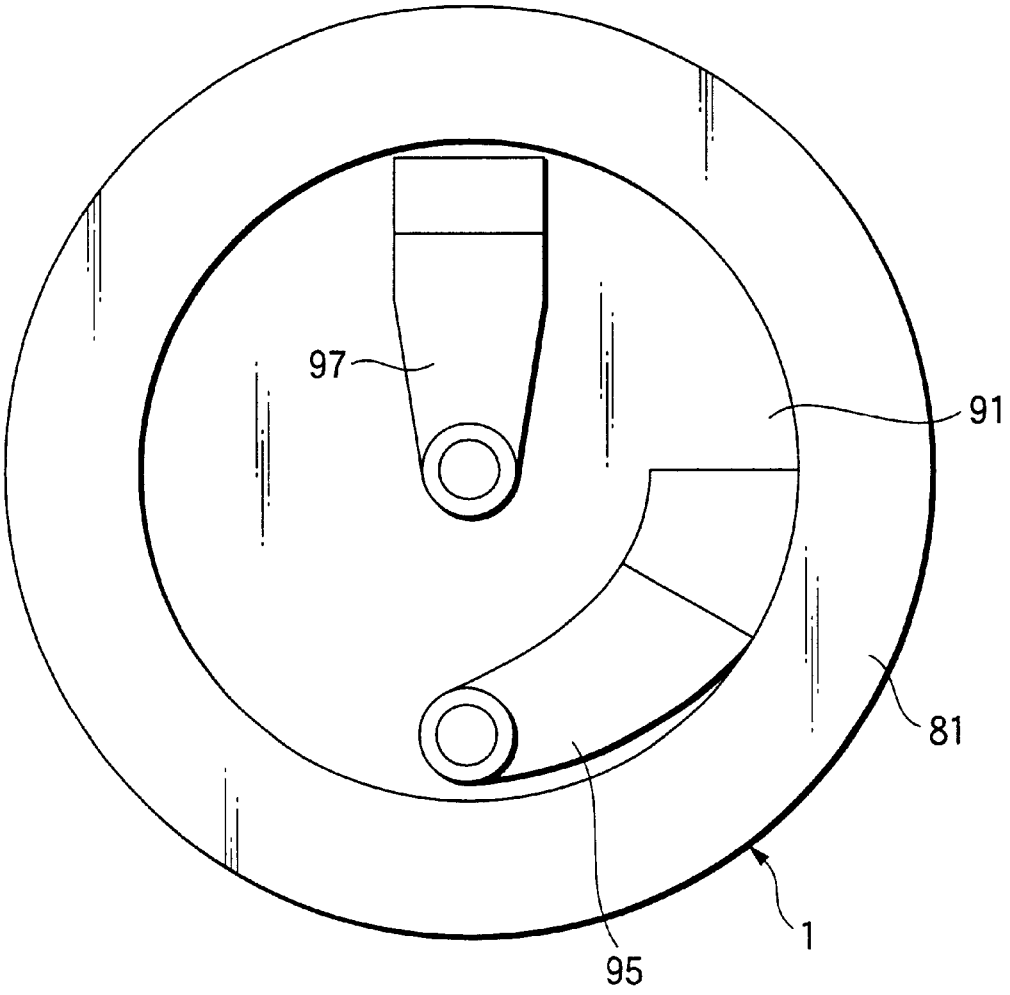
FIG. 18 is a bottom view showing a microphone serving as an electroacoustic transducer according to the sixth embodiment of the invention.

Next, a sixth embodiment of the invention will be described with reference to FIGS. 17 to 19. The first to fifth embodiments have been described with taking a sounder as an example of the electroacoustic transducer. The sixth embodiment will be described with taking a microphone as an example of an electroacoustic transducer.

The microphone is configured in the following manner. As shown in FIG. 17, the microphone has a rubber bush 81. The rubber bush 81 comprises an upper end opening 81*a* and a lower end opening 81*b*. A case 82 is housed in the rubber bush 81. The case 82 also comprises an upper end opening 82*a* and a lower end opening 82*b*.

A board 91 is housed in the case 82. Electronic components such as an impedance converting element 93 are mounted on the board 91. A support ring 84 is placed in the internal peripheral side of the case 82, and a conductive ring 89 is placed in the internal peripheral side of the support ring 84. A stepped portion 84*a* is formed in an upper end portion of the support ring 84. A back electrode 87 is disposed on the stepped portion 84*a*. A diaphragm 83 is disposed on the back electrode 87 with being clampingly held by a diaphragm ring 85. The diaphragm 83 and the back electrode 87 constitute a capacitor. An anode connecting terminal 97 and a cathode connecting terminal 95 are disposed on the lower face of the board 91.

A resin film having a metal deposition film of a thickness of several $\mu$m is bonded to the diaphragm ring 85. The back electrode 87 is separated from the diaphragm 83 by a gap of several tens of $\mu$m, and an electret made of Teflon or the like is firmly attached onto the side opposing to the diaphragm 83, so that the back electrode is charged at several hundreds of voltage. The back electrode 87 is connected to the board 91 via the conductive ring 89, and so as to be connected to the impedance converting element 93 which has been described above, on a pattern of the board 91.

A board of a device on which the microphone is to be mounted is configured in the same manner as that shown in FIG. 16 used in the fifth embodiment. In the board 41, the anode conductive part 75 and the cathode conductive part 77 are disposed in ring-like shapes which are concentric with each other, thereby eliminating directionality in a circumferential direction. As shown in FIG. 17, therefore, the anode connecting terminal 97 and the cathode connecting terminal 95 are requested only to be placed in given radial positions corresponding to the anode conductive part 75 and the cathode conductive part 77 of the board 41. According to this configuration, even when the microphone is mounted with being rotated in any angle in a circumferential direction, mounting is enabled under a state where the anode connecting terminal 97 and the cathode connecting terminal 95 are surely in contact with the anode conductive part 75 and the cathode conductive part 77, respectively.

Figure 19:
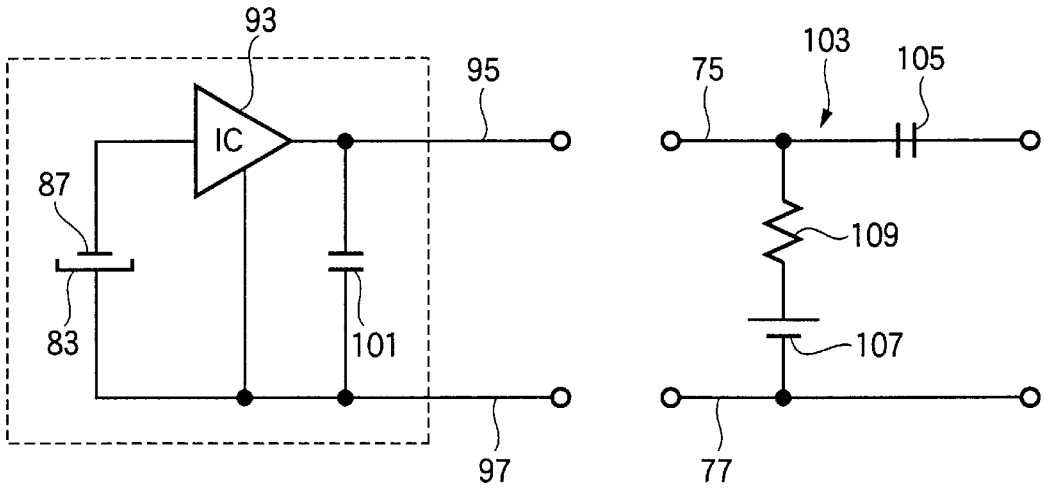
FIG. 19 is a diagram showing the circuit diagram of a microphone serving as an electroacoustic transducer according to the sixth embodiment of the invention.

The microphone has the circuit configuration shown in FIG. 19. In the figure, the reference numeral 101 denotes an anti-noise capacitor, and 103 denotes a circuit of the device. A capacitor 105, a power source 107, and a resistor 107 are disposed in the circuit of the device. The illustrated microphone is of the type in which acoustic oscillation of the diaphragm 83 is taken out in the form of a change in capacity of the capacitor 101.

In the thus configured microphone also, it is possible to attain the same effects, i.e., that directionality in a circumferential direction in mounting can be eliminated without separately using a sheet or a connector, and that the acoustic performance of the microphone can be prevented from being accidentally changed.

Figure 20:
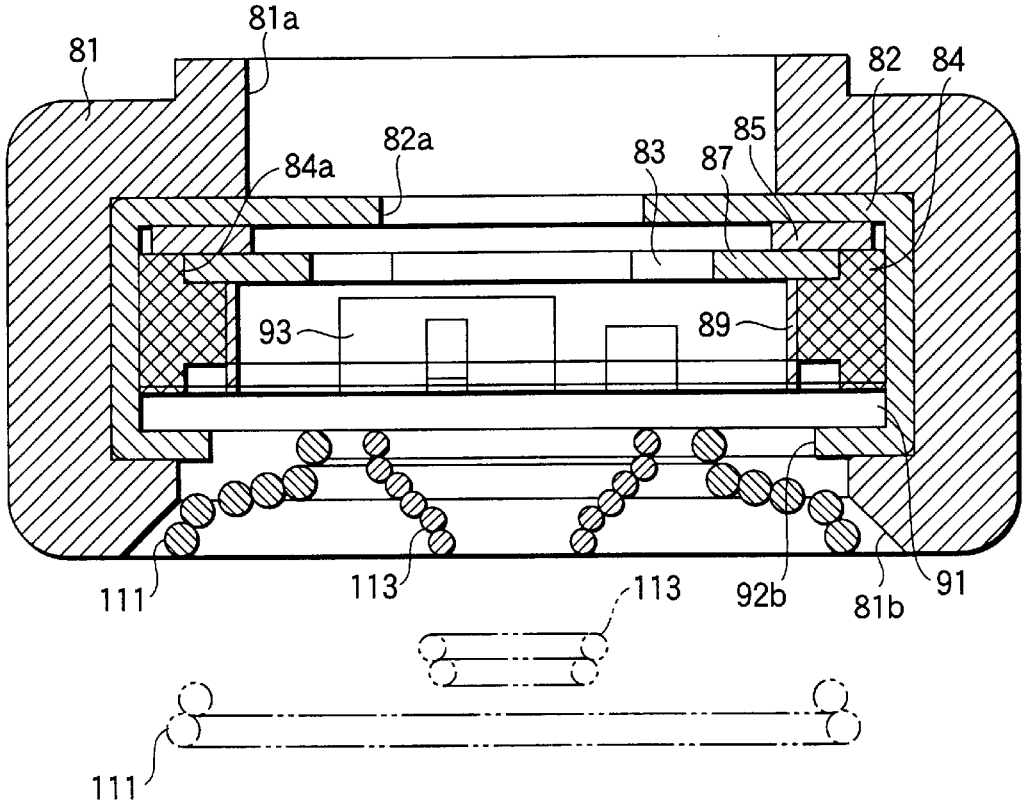
FIG. 20 is a section view showing a microphone serving as an electroacoustic transducer according to a seventh embodiment of the invention.
Figure 21:
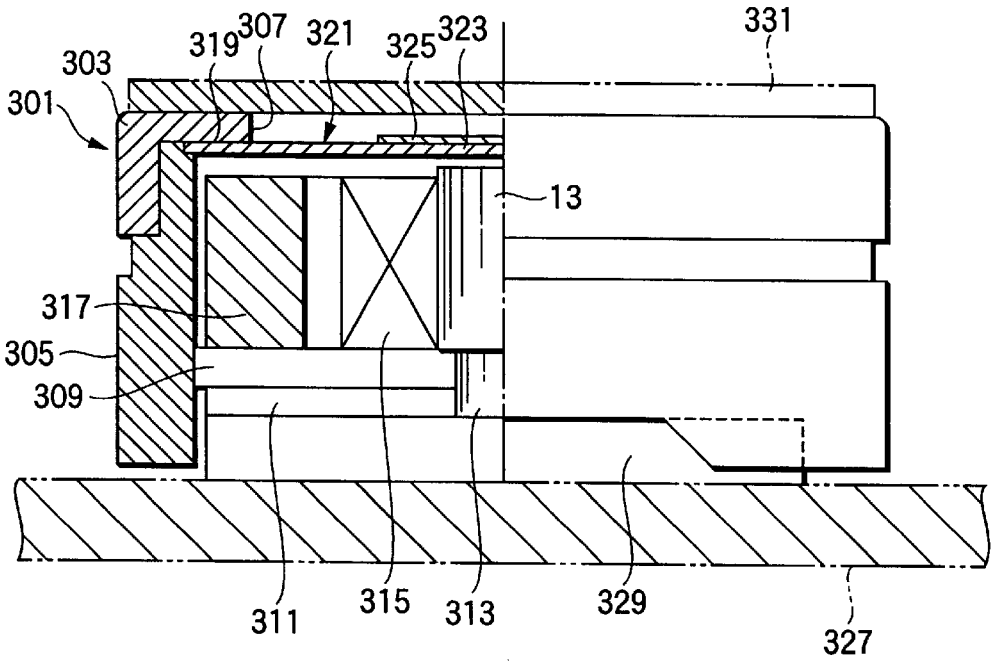
FIG.21 PRIOR ART
FIG. 21 is a half section view showing a conventional sounder serving as an electroacoustic transducer.
Figure 22:
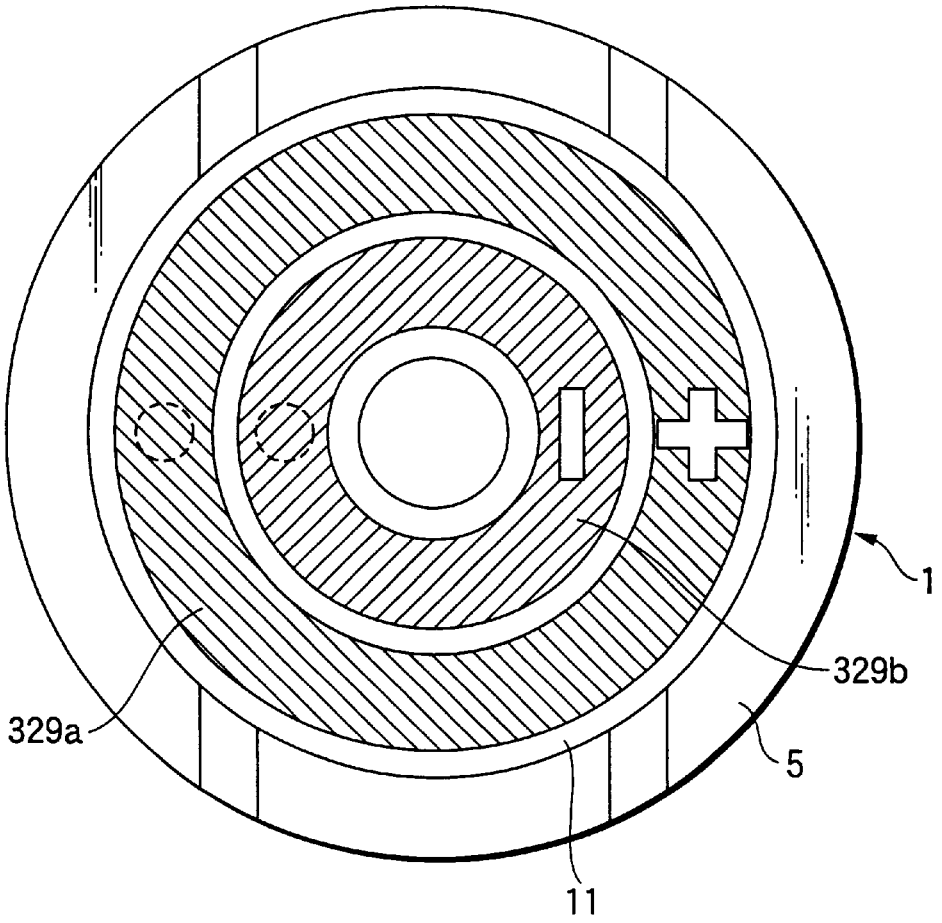
FIG.22 PRIOR ART
FIG. 22 is a bottom view showing a conventional sounder serving as an electroacoustic transducer.
Figure 23:
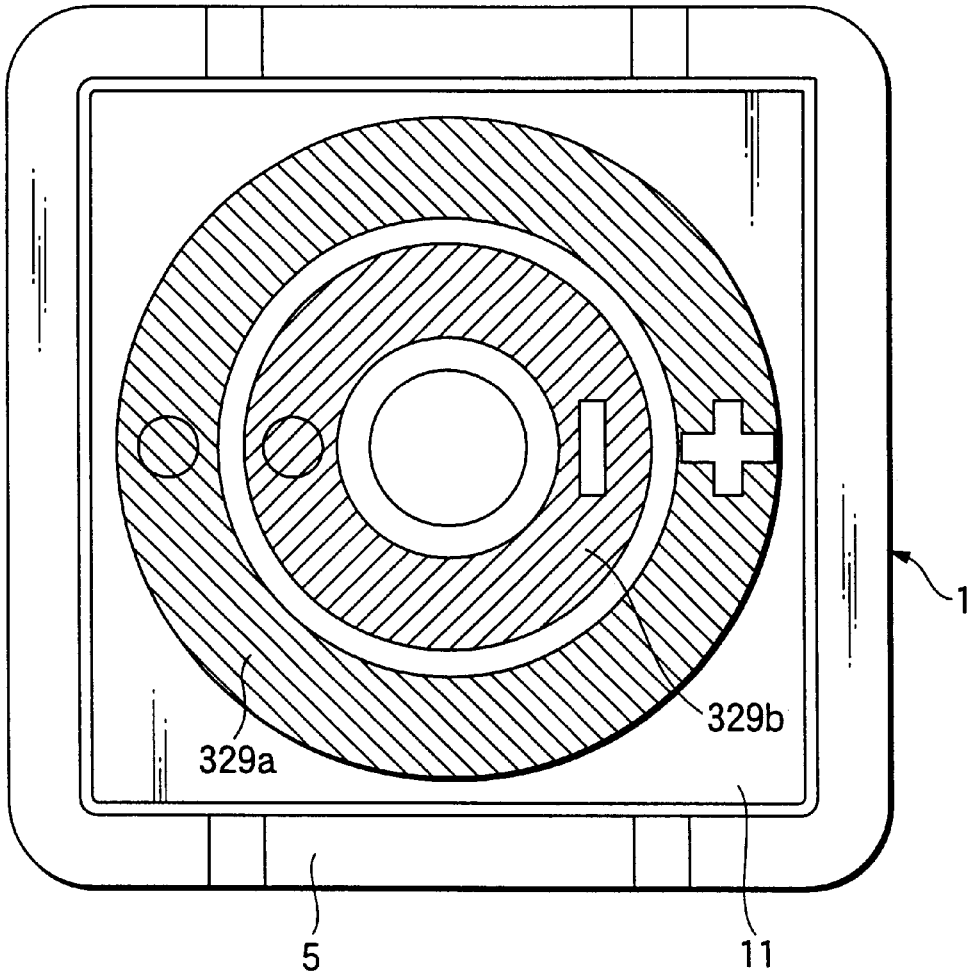
FIG.23 PRIOR ART
FIG. 23 is a bottom view showing another conventional sounder serving as an electroacoustic transducer.

Next, a seventh embodiment of the invention will be described with reference to FIG. 20. In the embodiment, a coil spring 113 is disposed in place of the anode connecting terminal 97 in the sixth embodiment, and a coil spring 111 is disposed in place of the cathode connecting terminal 95. The coil springs 111 and 113 are disposed in ring-like shapes which are concentric with each other. The coil spring 111 is configured so that its diameter is gradually increased toward the board 41 of the device. By contrast, the coil spring 113 is configured so that its diameter is gradually reduced toward the board 41 of the device. Namely, the distance between the coil springs 111 and 113 is gradually made larger toward the board 41 of the device. This configuration prevents the coil springs 111 and 113 from being accidentally contacted and short-circuited with each other when they are compressed in mounting.

The embodiment can attain the same effects as those of the embodiments described above, i.e., that directionality in a circumferential direction in mounting can be eliminated without separately using a sheet or a connector, and that the acoustic performance of the microphone can be prevented from being accidentally changed. Moreover, it is possible to prevent a short circuit due to a contact between the coil springs 111 and 113 in mounting from occurring.

Alternatively, one of the coil springs 111 and 113 may be configured in a straight structure, or the coil springs 111 and 113 may be configured by conical coil springs of the same direction and set so that the distance between the coils is larger toward the board of the device.

The invention is not restricted to the first to seventh embodiments.

Although the first to seventh embodiments have been described with taking a sounder (buzzer) or a microphone as an example of the electroacoustic transducer, the invention can be applied to a speaker in a same manner. In summary, the invention can be applied to a wide variety of electroacoustic transducers.

In the case where coil springs are employed as the anode conductive part and the cathode conductive part of the electroacoustic transducer, only the anode conductive part may be configured by a coil spring, only the cathode conductive part may be configured by a coil spring, or both the anode conductive part and the cathode conductive part may be configured by coil springs, respectively.

As described above in detail, according to the electroacoustic transducer and the structure for mounting an electroacoustic transducer according to the invention, directionality in a circumferential direction can be eliminated without separately using a sheet or a connector, whereby the mounting work can be facilitated, and, unlike the case where a sheet or a connector is separately used, the acoustic performance can be prevented from being accidentally changed.

The anode conductive part and/or the cathode conductive part may be configured by a coil spring. In this case, the contact with the board of the device can be more surely attained.

In the case where both anode conductive part and the cathode conductive part are respectively configured by coil springs and concentrically disposed, the distance between the coil springs may be made larger toward the board of the device. In this configuration, an accidental contact or short circuit when compressed in mounting can be prevented from occurring.

What is claimed is:

1. An electroacoustic transducer to be mounted on a board of a device, comprising:

a case comprising a cylindrical portion with a lower end;

an anode conductive part disposed in said case and which is to be in press contact with the board of the device, wherein a forward end portion of the anode conductive part protrudes by a small distance from the lower end of the cylindrical portion of the case; and a cathode conductive part which is to be in press contact with the board of the device, wherein said anode conductive part and said cathode conductive part are respectively placed at an axial center position or at predetermined positions in a radial direction to eliminate directionality in a circumferential direction, wherein said anode conductive part and said cathode conductive part are substantially ring-shaped and are concentric with each other, and further wherein said anode conductive part and said cathode conductive part are projected toward said board.

2. The electroacoustic transducer according to claim 1, further comprising a second board on which said anode and said cathode are mounted, wherein there is no sheet between said second board and the board of the device.

3. An electroacoustic transducer according to claim 1, further comprising:

a second board disposed in said case, said second board comprising an upper face, a lower face, and a pair of through holes extending through said board so as each to have an upper-face side and a lower-face side; and a coil comprising two coil ends that are electrically connected to separate ones of the upper-face sides of said pair of through holes, wherein said anode conductive part is electrically connected to the lower-face of said one of said pair of through holes so as to be electrically connected to said coil, and wherein said cathode conductive part is electrically connected to the lower-face side of another one of said pair of through holes so as to be electrically connected to said coil.

4. An electroacoustic transducer to be mounted on a board of a device, comprising:

a case comprising a cylindrical portion with a lower end;

an anode conductive part disposed in said case and which is to be in press contact with the board of the device, wherein a forward end portion of the anode conductive part protrudes from the lower end of the cylindrical portion of the case; and a cathode conductive part which is to be in press contact with the board of the device, wherein said anode conductive part and said cathode conductive part are respectively placed at an axial center position or at predetermined positions in a radial direction to eliminate directionality in a circumferential direction, wherein said anode conductive part and said cathode conductive part are substantially ring-shaped and are concentric with each other, and further wherein at least one of said anode conductive part and said cathode conductive part is a coil spring.

5. The electroacoustic transducer according to claim 4, wherein said anode conductive part and said cathode conductive part are coil springs disposed concentrically, and a distance between the coil springs is larger toward the board of the device.

6. The electroacoustic transducer according to claim 4, further comprising a second board on which said anode and said cathode are mounted, wherein there is no sheet between said second board and the board of the device.

7. An electroacoustic transducer according to claim 4, further comprising:

a second board disposed in said case, said second board comprising an upper side; and a coil disposed proximate said upper side of said board, wherein an end portion of said coil spring is passed through said board so as to be on said upper side and is connected to one end of said coil.

* * * * *